US007516788B2

(12) United States Patent
Gleitman et al.

(10) Patent No.: US 7,516,788 B2
(45) Date of Patent: Apr. 14, 2009

(54) METHODS OF MARKING A ZONE OF A WELLBORE FOR LOCALIZING THE SOURCE OF PRODUCED PARTICULATE

(75) Inventors: Daniel D. Gleitman, Houston, TX (US); Christopher Jones, Missouri City, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 270 days.

(21) Appl. No.: 11/711,923

(22) Filed: Feb. 28, 2007

(65) Prior Publication Data

US 2008/0202747 A1 Aug. 28, 2008

(51) Int. Cl.
*E21B 47/00* (2006.01)

(52) U.S. Cl. ..... 166/250.12; 166/252.6; 166/254.1

(58) Field of Classification Search ..... None
See application file for complete search history.

(56) References Cited

U.S. PATENT DOCUMENTS 3,566,979 A * 3/1971 Bennett et al. ..... 175/2
6,047,772 A 4/2000 Weaver et al. ..... 166/276
6,172,011 B1 1/2001 Card et al. ..... 507/204
6,328,105 B1 12/2001 Betzold ..... 166/280
6,691,780 B2 2/2004 Nguyen et al. ..... 166/254.1
6,725,926 B2 4/2004 Nguyen et al. ..... 166/254.1
2006/0052251 A1 * 3/2006 Anderson et al. ..... 507/103

* cited by examiner

*Primary Examiner*—Zakiya W. Bates
(74) *Attorney, Agent, or Firm*—Robert A. Kent; Booth, Albanesi, Schroeder LLC

(57) ABSTRACT

A method of localizing the source of a particulate produced with a fluid through a wellbore is provided, the method comprising the steps of: (A) providing marking composition comprising at least one marker that: (i) is capable of binding with a particulate; and (ii) has a detectable property distinguishable from the particulate; (B) introducing the marking composition: (i) through a wellbore; and (ii) into contact with at least a portion of a subterranean formation penetrated by the wellbore; (C) obtaining a fluid produced through the wellbore; and (D) analyzing a particulate produced with the produced fluid for the presence of the marker.

24 Claims, No Drawings

METHODS OF MARKING A ZONE OF A WELLBORE FOR LOCALIZING THE SOURCE OF PRODUCED PARTICULATE

CROSS-REFERENCE TO RELATED APPLICATIONS

Not applicable

STATEMENT REGARDING FEDERALLY SPONSORED RESEARCH OR DEVELOPMENT

Not Applicable.

REFERENCE TO A MICROFICHE APPENDIX

Not applicable.

TECHNICAL FIELD

The present invention relates generally to the recovery of fluid from a subterranean formation penetrated by a well bore. More particularly, the present invention relates to methods of determining the source of particulate being produced with a fluid produced through a wellbore having multiple production zones.

BACKGROUND

Transport of particulate solids, such as sand, during the production of fluid from a subterranean formation penetrated by a well bore is a continuing problem. The transported particulate solids can erode or cause significant wear in the production equipment used in the fluid production process. The particulates also can clog or plug the well bore thereby limiting or completely stopping fluid production. Further, the transported particulates may need to be separated from the produced fluid adding further expense to the processing.

The particulates that are transported during production of fluid may be present for various reasons. In some cases, the particulates are naturally occurring, for example, due to an unconsolidated or weakly consolidated nature of a subterranean formation. In other cases, the particulates can be present as a result of well treatments placing particulates in a well bore or formation, such as in gravel packing or fracturing operations. Gravel packing in a well may include the use of gravel, sand, or both, and the gravel often includes some sand. In the treatment of subterranean formations, it is common to place particulate materials, such as sand, as a filter medium and/or as a proppant in the near well bore area and in fractures extending outwardly from the well bore.

For example, in fracturing operations, proppant is carried into fractures created when hydraulic pressure is applied to these subterranean rock formations to a point where fractures are developed. Proppant suspended in a viscosified fracturing fluid is carried outwardly away from the well bore within the fractures as they are created and extended with continued pumping. Upon release of pumping pressure, the proppant materials remain in the fractures holding the separated rock faces in an open position forming a channel for flow of formation fluids back to the well bore.

Proppant flowback is the transport of proppant material back into the well bore with the production of formation fluids following fracturing. This undesirable result causes problems such as undue wear on production equipment and the need for separation of solids from the produced fluid. Proppant flowback occasionally also decreases the efficiency of the fracturing operation because the proppant does not remain within the fracture and may limit the width or conductivity of the created flow channel.

Current techniques for controlling the flowback of proppant include coating the particulate with curable resin, or blending the particulate material with fibrous materials, tackifying agents, or deformable particulates. E.g., U.S. Pat. No. 6,328,105 to Betzold, U.S. Pat. No. 6,172,011 to Card et al., and U.S. Pat. No. 6,047,772 to Weaver et al.

For a multi-zone well that has been fractured with proppant and is plagued with proppant flowback problems, it is quite difficult to identify the zone from which the proppant is emanating unless the proppant is tagged with a tracer.

Radioactive materials have been commonly used in the logging or tagging of sand or proppant placement, however, such techniques do not address particulate that may have been previously placed in operations such as gravel packing or fracturing. Further, such radioactive materials are hazardous to the environment and the techniques for utilizing such radioactive materials are complex, expensive, and time consuming.

Sometimes, particulates produced during fluid production can have multiples sources from different zones of a wellbore and for different causes.

Particulate production from a wellbore can be a normal, expected, and predictable process. At times, however, it may be different from the normal or expected. This can be indicative of a geomechanical failure in a zone at or near the wellbore.

It is possible to easily measure at the surface particulate production, which measurements can be evaluated as being normal or abnormal. More difficult is to directly relate the sand production to particular zones or locations. In many well architecture and completion approaches, for example, in multiple zone completions, long completion zones, deviated or horizontal wellbores, and multilateral completions, being able to do so would be particularly valuable. There are also multi-well developments including off-shore scenarios wherein production from two or more wells may be combined (e.g. at a sub-sea manifold), and the combined production flow may include particulate production from one or the other well.

Being able to easily localize the source of particulate production would drive better focus on decisions for remediation actions to take (or not take), such as whether and where to clean-out, adjust production rates, cement, plug, open or close windows, abandon a wellbore, etc. Therefore, there is a need for methods for localizing the source of particulate production in subterranean wells to avoid the above problems.

U.S. Pat. No. 6,725,926 issued Apr. 27, 2004, having for named inventors Philip D. Nguyen, Jimmie D. Weaver, and Johnny A. Barton, filed on Nov. 18, 2002, discloses as described in the abstract thereof compositions and methods for determining the source of treatment fluids being produced from a production formation having multiple zones by introducing a treatment composition having a tracking material into a zone in the subterranean formation, and detecting the tracking material in the treatment composition so that if flows back from the subterranean formation. The entirety of U.S. Pat. No. 6,725,926 is incorporated herein by reference.

SUMMARY OF THE INVENTION

According to a the invention, a method of localizing the source of a particulate produced with a fluid through a wellbore is provided, the method comprising the steps of: (A)

providing marking composition comprising at least one marker that: (i) is capable of binding with a particulate; and (ii) has a detectable property distinguishable from the particulate; (B) introducing the marking composition: (i) through a wellbore; and (ii) into contact with at least a portion of a subterranean formation penetrated by the wellbore; (C) obtaining a fluid produced through the wellbore; and (D) analyzing a particulate produced with the produced fluid for the presence of the marker.

According to a further aspect of the invention, a method of localizing the source of a particulate produced with a fluid through a wellbore is provided, the method comprising the steps of: (A) providing a plurality of marking compositions, each of the plurality of marking compositions comprising at least one marker that: (i) is capable of binding with a particulate; and (ii) has a detectable property distinguishable from the particulate; wherein each of the plurality of marking compositions has a detectable property distinguishable from the other one or more of the plurality of marking compositions; (B) introducing each of the plurality of marking compositions: (i) through a wellbore; and (ii) into contact with at least a portion of a subterranean formation penetrated by the wellbore; wherein each of the plurality of marking compositions is introduced into a different portion of the wellbore; (C) obtaining a fluid produced through the wellbore; and (D) analyzing a particulate produced with the produced fluid for the presence of at least one of the markers in at least one of the plurality of marking compositions.

According to yet another aspect of the invention, a method of localizing the source of a particulate produced with a fluid through a wellbore is provided, the method comprising the steps of: (A) providing a plurality of marking compositions, each of the plurality of marking compositions comprising at least one marker that: (i) is capable of binding with a particulate; and (ii) has a detectable property distinguishable from the particulate; wherein each of the plurality of marking compositions has a detectable property distinguishable from the other one or more of the plurality of marking compositions; (B) introducing each of the plurality of marking compositions: (i) through a wellbore; and (ii) into contact with at least a portion of a subterranean formation penetrated by the wellbore; wherein each of the plurality of marking compositions is introduced into a different radial depth of the subterranean formation penetrated by the wellbore; (C) obtaining a fluid produced through the wellbore; and (D) analyzing a particulate produced with the produced fluid for the presence of at least one of the markers in at least one of the plurality of marking compositions.

Other and further objects, features and advantages of the present invention will be readily apparent to those skilled in the art when the following description of the preferred embodiments is read in conjunction with the accompanying drawings.

DETAILED DESCRIPTION

As used herein and in the appended claims, the words "comprise," "has," and "include" and all grammatical variations thereof are each intended to have an open, non-limiting meaning that does not exclude additional elements or parts of an assembly, subassembly, or structural element.

As used herein, "particulate" specifically means a particulate substance having a size range up to and including the size range of sand. Further, the particulate can comprise at least one mineral material, coal material, such as coal fines, or an organic material, such as a resin.

As used herein, "sand" means a loose granular material that results from the disintegration of rocks. Sand typically consists of particles smaller than gravel but coarser than silt. As used herein, sand typically ranges in size from about 0.06 mm to about 2 mm in the longest cross-sectional dimension. Sand may be naturally present in a subterranean formation. It may be unconsolidated in the formation or variably consolidated as sandstone. Sand grains often represent 65-95% quartz, with other minerals present with the grains.

As used herein, the word "plurality" means two or more. In the context of a wellbore the words "uphole" and "downhole" are with reference to the direction toward the surface, regardless of whether the borehole is vertical, deviated, or horizontal.

If there is any conflict in the usages of a word or term in this specification and one or more patent or other documents that may be incorporated herein by reference, the definitions that are consistent with this specification should be adopted for the purposes of understanding this invention.

In general, methods are provided for marking the particulate existing in one or more zones of interest in a well so as to be able to localize the source of evolution of such particulate.

According to the invention, a method of localizing the source of a particulate produced with a fluid through a wellbore is provided, the method comprising the steps of: (A) providing marking composition comprising at least one marker that: (i) is capable of binding with a particulate; and (ii) has a detectable property distinguishable from the particulate; (B) introducing the marking composition: (i) through a wellbore; and (ii) into contact with at least a portion of a subterranean formation penetrated by the wellbore; (C) obtaining a fluid produced through the wellbore; and (D) analyzing a particulate produced with the produced fluid for the presence of the marker. The wellbore may be associated with production of hydrocarbons, in which case the produced fluids may include oil, gas, and/or water. In certain cases such as coal bed methane operations the wellbore may penetrate a subterranean coal formation, and the produced fluid may be primarily water. In some cases the wellbore may be in an aquifer for production of water.

In some embodiments according to the invention, the particulate that the marker is adapted to bind to is a solid particulate commonly present in sand, such as a mineral. The mineral that the marker is adapted to bind to may be preferably selected from the group consisting of: a silicate class mineral, such as feldspar, clay minerals (e.g. illite, smectite, illite-smectite combinations, chlorite, kaolinite, and other less common types), mica (e.g. muscovite, biotite, and other types), a heavy mineral, such as garnet, zircon, amphibole, and other less common types); a carbonate class mineral, such as calcite, aragonite, dolomite, siderite, ankerite, and other less common types; a sulfate class mineral, such as anhydrite, gypsum, and others less common types; a sulfide class mineral, such as pirite, sphalerite, galena, and others less common types; an oxide class mineral, such as hematite, magnetite, ruitile and polymorphs, ilminite, and other less common types; a halide class mineral, such as sodium chloride, sylvite, and other less common types; and a phosphate class mineral, such as apatite. It is desirable, but not required, that the marker be capable of binding to more than one mineral. The marker may be adapted to bind to organic materials, more than one type of organic material, or both mineral and organic material.

While the marker may bind to other materials, it is preferable that the marker be adapted to selectively bind with a solid particulate while minimizing the tendency for it to bind with other surfaces, such as the metallic or plastic surfaces of containers, well tubulars, or downhole well tools. Having the marker bind to other non-mineral materials or surfaces would not be expected to prevent the marker from functioning however, as such materials and surfaces would be unlikely to be mobile in a fluid produced from a wellbore.

The particulate that the marker should be adapted to bind to is selected for being expected or likely to be in particulate form already existing in the portion of the subterranean formation. The particulate can be naturally occurring in the portion of the subterranean formation. In addition or alternatively, the particulate can have been previously placed in the portion of the subterranean formation by a well operation. For example, the particulate can have been previously placed in the portion of the subterranean formation by a gravel packing or fracturing operation.

The marker preferably comprises a substance which is soluble in either water-based or oil-based fluids which may be used in well operations, as a means of conveying it to formation. The marker preferably comprises a substance detectable by spectral response, e.g. a dye detectable by color. Such dye may be selected from the group consisting of: "acid blue" water-soluble dyes and "oil red" oil-soluble dyes. Other optically active substances which could serve as spectrally detectable markers may include molecular iodine, iron oxide class pigments, chrome oxide pigments, mica ferric oxide pigments, other oxide or inorganic pigments, or organic pigments. "Methylene blue" pigment may be used. Other markers may be used which are detectable in the non-visible spectrum. Certain substances may serve as markers which may be less detectable until an activation step is taken, following which the marker would be more easily detected spectrographically. Examples of such substances may include amides, amines, or phenols. Numerous activator chemicals are known, one example being catalog # EM-14750-1 from VWR International. The bond between a marker substance and a target particulate may for example be polar bonds, van der wal bonds, or di-pole/di-pole bond. Certain marker substances may chemically bond to the target particulate. Many of the marker substances named above have excellent properties for use in high temperature environments (e.g. many for temperatures greater than 100° C., or even greater than 200° C.), which may be useful for example in subterranean formations undergoing steam assisted production of hydrocarbons.

The marker can have a preferential affinity for the one or more particulate targets in their relevant downhole condition (e.g. pH). For example, sand bearing formations may be somewhat acidic. Because of this preferential affinity, an oil-based drilling or completion fluid, for example, may be used to convey an oil-soluble marker, which will bind with and remain bound to the minerals of interest, even as oil is being produced through or with such sands. Similarly, a water-based conveying fluid may be used, and/or the formation may subsequently be subject to water injection or production, but the marker should remain bound to the minerals because of the binding affinity. Upon production of the sand however, the marker can be disassociated with the mineral through, for example, soaking in an appropriate solvent, such as a water-based fluid at an appropriate pH.

The marker can be a mixture of one or more chemicals having a detectable property and other ingredients or materials that do not interfere with the detectability of the detectable property of the chemical. For example, the marker can comprise a mixture of dye or other coloring agent and adhesive. More particularly, for example, the marker can be a pigment or paint that is capable of adhering to an appropriate particulate and that is detectable by color.

The marker can also be a mixture of a plurality of chemicals, each having a distinctive chemical property, wherein the combination of chemicals defines a distinctive combination of detectable properties. Of course, the marker can be a mixture of such plurality of chemicals with other ingredients or materials that do not interfere with the detectability of the combination of detectable properties of the chemicals. For example, a ratio of dyes or colorants can be used to uniquely identify a particular marker.

The marker can comprise or include a radioactive material. However, radioactive materials are hazardous to the environment and the techniques for utilizing such radioactive materials are complex, expensive, and time consuming. Preferably, the marker is substantially non-radioactive.

The marking composition can be a mixture of the marker and a solvent or diluent for the marker. Further, the marking composition can include a diluent or a carrier fluid for use in introducing the marker into a wellbore and delivering the marker to a portion of a subterranean formation penetrated by the wellbore.

The marker can also relate to a particular concentration or dilution level of a chemical or relate to relative concentrations of a plurality of chemicals. For example, the marker can be a single chemical in two or more dilutions that would bind to the target particulate(s) distinctly, so as to produce two different results (e.g. intensity responses) in analysis. By way of another example, the marker can be a single concentration of chemical which is introduced to the sand-containing formation in each of two or more locations (or radial depths), for deliberately different binding amounts, which may be related to the time of exposure—e.g. 10 minutes of exposure for one zone, 30 minutes for another.

The marking composition preferably does not include any substantial amount of any material that the marker would bind to or that would interfere with the marker being able to bind with the particulate.

During the step of introducing the marker composition into the wellbore, the marking composition is preferably not mixed with substantial amounts of any material that the marker would bind to or that would interfere with the marker being able to bind with the particulate, whereby the marker can bind to any of the particulate already existing in the portion of the subterranean formation.

The invention contemplates several different techniques for the step of introducing the marker composition through a wellbore and into contact with at least a portion of a subterranean formation. According to one such technique, the step of introducing further comprises mixing the marking composition with a drilling mud used in drilling the portion of the subterranean formation. According to another such technique, the step of introducing further comprises: mixing the marking composition with a gravel or sand used in a gravel packing or fracturing operation adjacent or in the subterranean formation. According to another such technique, the step of introducing further comprises introducing the marking composition during a wiper trip passing the portion of the subterranean formation. According to yet another technique, the step of introducing further comprises circulating the marking composition to the portion of the subterranean formation with a pill. According to still another technique, the step of introducing further comprises spot-placement of the marker composition in the portion of the subterranean formation with coil tubing, jointed pipe, or other intervention through the wellbore.

According to a further aspect of the invention, the step of introducing the marker composition further comprises temporarily isolating the portion of the subterranean formation from at least one other portion of the wellbore. The step of temporarily isolating the portion of the subterranean formation can further comprise positioning a packer in the wellbore adjacent an end of the portion of the subterranean formation. For example, a packer can be positioned in the wellbore to isolate an uphole portion of the wellbore from a downhole portion of the wellbore. The step of temporarily isolating the portion of the subterranean formation can further comprise positioning another packer in the wellbore adjacent another end of the portion of the subterranean formation. According to this embodiment, a downhole packer isolates a portion of the wellbore from a downhole portion of the wellbore and an uphole packer isolates the portion of the wellbore from an uphole portion of the wellbore, thereby isolating the portion of the wellbore in between. It is contemplated that a sand plug or other techniques known to those of skill in the art can be used to isolate a portion of a wellbore.

The step of introducing the marking composition can further comprise applying the marking composition superficially to the face of the portion of the subterranean formation. According to another technique of the invention, the step of introducing can further comprise forcing the marking composition into the formation. Depending on the uniformity of the matrix of the subterranean formation surrounding the portion of the wellbore where the marking composition is introduced, the marking composition can be forced to penetrate a predictable and uniform radial depth outward from the wellbore. Forcing the marking composition into the portion of the formation can be accomplished, for example, by over-balancing, jetting, or explosive perforating, as will be appreciated by those of skill in the art.

According to one technique according to the invention, the step of analyzing further comprises: (A) collecting a sample of the particulate from the produced fluid; and (B) analyzing the sample of the particulate for the detectable property of the marker. According to another technique of the invention, the step of analyzing further comprises: (A) collecting a sample of the particulate from the produced fluid; (B) extracting any of the marker from the sample of the particulate; and (C) analyzing for the marker. The step of collecting can include obtaining a sample of produced fluid from a production pipe, with the fluid sample of sufficient volume to yield on the order of a gram of solids (particulate) or more. The solids may be separated from the produced fluid by any one or more of sieving, centrifuge, filtering, washing, or other techniques known. Washing may be with a fluid that is incompatible with marker, so as to not dissolve the marker. The step of extracting may include soaking the solids in a compatible solute fluid appropriate for dissolving the marker from the particulate, e.g. for an acid blue dye marker a basic solution such as KOH or NaOH may be used for the soak. The step of analyzing can further comprise, for example, any one or more of the following analytical techniques: absorption spectroscopy (e.g., UV, visible, IR), emission spectroscopy (e.g., fluorescence, flame-emission, X-Ray fluorescence), scattering spectroscopy (e.g., Raman spectroscopy). For certain marker substance types the step of analyzing may include addition of an activator substance to increase the detectability of the marker substance. Chromatography techniques may alternatively or in combination be employed for the analyzing step. Other analytical techniques or combinations of techniques are also included within the scope of the invention.

As previously discussed, the marker composition can comprise a plurality of markers. In such case, preferably each marker: (i) is capable of binding with a particulate; (ii) has a detectable property distinguishable from the particulate; and (iii) has a detectable property distinguishable from another marker in the marker composition.

According to a further aspect of the invention, a method of localizing the source of a particulate produced with a fluid through a wellbore is provided, the method comprising the steps of: (A) providing a plurality of marking compositions, each of the plurality of marking compositions comprising at least one marker that: (i) is capable of binding with a particulate; and (ii) has a detectable property distinguishable from the particulate; wherein each of the plurality of marking compositions has a detectable property distinguishable from the other one or more of the plurality of marking compositions; (B) introducing each of the plurality of marking compositions: (i) through a wellbore; and (ii) into contact with at least a portion of a subterranean formation penetrated by the wellbore; wherein each of the plurality of marking compositions is introduced into a different portion of the wellbore; (C) obtaining a fluid produced through the wellbore; and (D) analyzing a particulate produced with the produced fluid for the presence of at least one of the markers in at least one of the plurality of marking compositions.

In a preferred embodiment according to this aspect of the invention, at least one of the plurality of marker compositions comprises a plurality of markers, wherein each of the plurality of markers: (i) is capable of binding with a particulate; (ii) has a detectable property distinguishable from the particulate; and (iii) has a detectable property distinguishable from the other marker or markers in the marker composition.

According to another preferred embodiment, each of the plurality of marker compositions has a different ratio of a plurality of markers, wherein each of the plurality of markers: (i) is capable of binding with a particulate; (ii) has a detectable property distinguishable from the particulate; and (iii) has a detectable property distinguishable from the other marker or markers in the marker composition; whereby the different ratio of the plurality of markers in each of the plurality of marker compositions is the detectable property distinguishable from the other one or more of the plurality of marking compositions. It is preferable but not necessary to use careful selection of the concentration of markers for a plurality of markers. It is desirable to avoid using concentration sets (or marker sets) that are a linear combination, with non negativity constraints, that are to be used in the same well for different zones. It is also useful but not necessary to select markers with similar bonding characteristics when used in a single marker set so that the marker concentrations do not fractionate on the bonding surface of the particulate. Additionally, this allows the removal process to be simplified as only one step is necessary for all markers of the set to be removed from the particulate. For example, each of the plurality of marker compositions can have a ratio of a plurality of markers, wherein the ratio of one marker to the other one or more of the plurality of markers is in the range from 0%:100% to 100%:0%. The difference in ratios can be advantageous used to distinguish each of the plurality of marker compositions from another. In this embodiment, this can be used to differentiate the portion of a wellbore from which a produced particulate originates.

According to yet another aspect of the invention, a method of localizing the source of a particulate produced with a fluid through a wellbore is provided, the method comprising the steps of: (A) providing a plurality of marking compositions, each of the plurality of marking compositions comprising at least one marker that: (i) is capable of binding with a particulate; and (ii) has a detectable property distinguishable from the particulate; wherein each of the plurality of marking compositions has a detectable property distinguishable from the other one or more of the plurality of marking compositions;

(B) introducing each of the plurality of marking compositions: (i) through a wellbore; and (ii) into contact with at least a portion of a subterranean formation penetrated by the wellbore; wherein each of the plurality of marking compositions is introduced into a different radial depth of the subterranean formation penetrated by the wellbore; (C) obtaining a fluid produced through the wellbore; and (D) analyzing a particulate produced with the produced fluid for the presence of at least one of the markers in at least one of the plurality of marking compositions.

In a preferred embodiment according to this aspect of the invention, at least one of the plurality of marker compositions comprises a plurality of markers, wherein each of the plurality of markers: (i) is capable of binding with a particulate; (ii) has a detectable property distinguishable from the particulate; and (iii) has a detectable property distinguishable from the other marker or markers in the marker composition.

According to another preferred embodiment, each of the plurality of marker compositions has a different ratio of a plurality of markers, wherein each of the plurality of markers: (i) is capable of binding with a particulate; (ii) has a detectable property distinguishable from the particulate; and (iii) has a detectable property distinguishable from the other marker or markers in the marker composition; whereby the different ratio of the plurality of markers in each of the plurality of marker compositions is the detectable property distinguishable from the other one or more of the plurality of marking compositions. The method wherein each of the plurality of marker compositions has a ratio of a plurality of markers, wherein the ratio of one marker to the other one or more of the plurality of markers is in the range from 0%:100% to 100%:0%. The difference in ratios can be advantageous used to distinguish each of the plurality of marker compositions from another. In this embodiment, this can be used to differentiate the radial depth into a subterranean formation around a wellbore from which a produced particulate originates.

Preferably, the step of analyzing for the presence of the at least one marker further comprises the step of quantitative analysis for the marker. The quantitative analysis can be used, for example, to identify the source of the particulate by the concentration of the marker on the particulate or, for example, by identifying the ratio of markers present on the particulate.

It is to be understood that the various steps according to preferred methods of the invention can be advantageously practiced in various combinations. It is also to be understood that the steps according to the invention and various preferred embodiments of the invention can be repeated at different intervals of the same wellbore.

An example of an important application for the methods according to the invention is in completions for heavy oil production, where for example information is desired regarding the location or interval of associated sand production, or information is desired so as to rule out a particular location or interval as a source of produced sand.

In certain embodiments of the invention, following the analyzing step a production optimization step may be taken which may be responsive to the particulate production localized source indicated in the analysis, and may be taken to reduce the particulate production from the localized source. Such production optimization may include one or more of: adjusting a valve or other control element to shut in or adjust production rate of a well or a zone of a well; performing an intervention to apply a chemical or cement to a zone; installing or moving a packer or plug; or performing other techniques known.

Depending upon the subterranean environment and other factors, various solid-phase particulate material may be produced with produced fluids, any of which are markable and separable from the produced fluids for analysis. The scope of the invention includes the marking of any such subterranean solids. Coal formations may produce coal fines with the produced fluids, and the methods identified herein may be applicable for identifying, localizing, and responding to coal fine production. Certain formations may produce organic solids in conjunction with produced fluids, which may be in conjunction with produced sands, and the methods identified herein may be applicable for identifying, localizing, and responding to produced solids containing organic materials.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of localizing the source of a particulate produced with a fluid through a wellbore, the method comprising the steps of:

(A) providing marking composition comprising at least one marker that:
  (i) is capable of binding with a particulate; and
  (ii) has a detectable property distinguishable from the particulate;
(B) introducing the marking composition:
  (i) through a wellbore; and
  (ii) into contact with at least a portion of a subterranean formation penetrated by the wellbore;
(C) obtaining fluid produced through the wellbore; and
(D) analyzing a particulate produced with the produced fluid for the presence of the marker.

2. The method according to claim 1, wherein the particulate is insoluble in water.

3. The method according to claim 2, wherein the particulate comprises a mineral material, a coal material, or an organic material.

4. The method according to claim 3, wherein the particulate comprises a mineral selected from the group consisting of a silicate class mineral; a carbonate class mineral; a sulfate class mineral; a sulfide class mineral; an oxide class mineral; a halide class mineral; and a phosphate class mineral.

5. The method according to claim 1, wherein the marker comprises a substance detectable by spectroscopy.

6. The method according to claim 5, wherein the substance detectable by spectroscopy is a dye selected from the group consisting of: "acid blue" and "oil red" dyes.

7. The method according to claim 1, wherein the marker comprises a substance from the group consisting of: inorganic pigments and organic pigments.

8. The method according to claim 1, wherein the marker is substantially non-radioactive.

9. The method according to claim 1, wherein the step of introducing further comprises: mixing the marking composition with a fluid circulated during one or more of the following: drilling the portion of the subterranean formation, wiping the portion of the subterranean formation, or circulating a pill to contact the portion of the subterranean formation.

10. The method according to claim 1, wherein the step of introducing further comprises: mixing the marking composition with a gravel or sand used in a gravel packing or fracturing operation adjacent or in the subterranean formation.

11. The method according to claim 1, wherein the step of introducing further comprises: spot-placement in the portion of the subterranean formation with intervention string through the wellbore.

12. The method according to claim 1, wherein the step of introducing further comprises: temporarily isolating the portion of the subterranean formation from at least one other portion of the wellbore.

13. The method according to claim 1, wherein the step of introducing further comprises: applying the marking composition superficially to the face of the portion of the subterranean formation.

14. The method according to claim 1, wherein the step of introducing further comprises: forcing the marking composition into the formation.

15. The method according to claim 14, wherein forcing the marking composition into the portion of the formation is accomplished by over-balancing, jetting, fracturing, or explosive perforating.

16. The method according to claim 1, wherein the step of analyzing further comprises:

(A) collecting a sample of the particulate from the produced fluid;

(B) extracting any of the marker from the sample of the particulate; and (C) analyzing for the marker.

17. The method according to claim 1, wherein the step of analyzing further comprises any one or more of: absorption spectroscopy, emission spectroscopy, and scattering spectroscopy.

18. The method according to claim 1, wherein the marker composition comprises a plurality of markers, wherein each marker:

(i) is capable of binding with a particulate;

(ii) has a detectable property distinguishable from the particulate; and (iii) has a detectable property distinguishable from another marker in the marker composition.

19. A method of localizing the source of a particulate produced with a fluid through a wellbore, the method comprising the steps of:

(A) providing a plurality of marking compositions, each of the plurality of marking compositions comprising at least one marker that:

(i) is capable of binding with a particulate; and (ii) has a detectable property distinguishable from the particulate;

wherein each of the plurality of marking compositions has a detectable property distinguishable from the other one or more of the plurality of marking compositions;

(B) introducing each of the plurality of marking compositions:

(i) through a wellbore; and (ii) into contact with at least a portion of a subterranean formation penetrated by the wellbore;

wherein each of the plurality of marking compositions is introduced into a different portion of the wellbore;

(C) obtaining fluid produced through the wellbore; and (D) analyzing a particulate produced with the produced fluid for the presence of at least one of the markers in at least one of the plurality of marking compositions.

20. The method according to claim 19, wherein at least one of the plurality of marker compositions comprises a plurality of markers, wherein each of the plurality of markers:

(i) is capable of binding with a particulate;

(ii) has a detectable property distinguishable from the particulate; and (iii) has a detectable property distinguishable from the other marker or markers in the marker composition.

21. A method of localizing the source of a particulate produced with a fluid through a wellbore, the method comprising the steps of:

(A) providing a plurality of marking compositions, each of the plurality of marking compositions comprising at least one marker that:

(i) is capable of binding with a particulate; and (ii) has a detectable property distinguishable from the particulate;

wherein each of the plurality of marking compositions has a detectable property distinguishable from the other one or more of the plurality of marking compositions;

(B) introducing each of the plurality of marking compositions:

(i) through a wellbore; and (ii) into contact with at least a portion of a subterranean formation penetrated by the wellbore;

wherein each of the plurality of marking compositions is introduced into a different radial depth of the subterranean formation penetrated by the wellbore;

(C) obtaining fluid produced through the wellbore; and (D) analyzing a particulate produced with the produced fluid for the presence of at least one of the markers in at least one of the plurality of marking compositions.

22. The method according to claim 21, wherein at least one of the plurality of marker compositions comprises a plurality of markers, wherein each of the plurality of markers:

(i) is capable of binding with a particulate;

(ii) has a detectable property distinguishable from the particulate; and (iii) has a detectable property distinguishable from the other marker or markers in the marker composition.

23. The method according to claim 21, wherein each of the plurality of marker compositions has a different ratio of a plurality of markers, wherein each of the plurality of markers:

(i) is capable of binding with a particulate;

(ii) has a detectable property distinguishable from the particulate; and (iii) has a detectable property distinguishable from the other marker or markers in the marker composition;

whereby the different ratio of the plurality of markers in each of the plurality of marker compositions is the detectable property distinguishable from the other one or more of the plurality of marking compositions.

24. The method according to claim 21 further comprising: a production optimization step responsive to the particulate production.

* * * * *